US007059981B2

(12) United States Patent
Ashino et al.

(10) Patent No.: US 7,059,981 B2
(45) Date of Patent: Jun. 13, 2006

(54) RACKET FRAME

(75) Inventors: Takeshi Ashino, Hyogo (JP); Kunio Niwa, Hyogo (JP)

(73) Assignee: SRI Sports Limited, Hyogo (JP)

( * ) Notice: Subject to any disclaimer, the term of this patent is extended or adjusted under 35 U.S.C. 154(b) by 141 days.

(21) Appl. No.: 10/855,606

(22) Filed: May 28, 2004

(65) Prior Publication Data

US 2005/0003912 A1 Jan. 6, 2005

(30) Foreign Application Priority Data

Jul. 4, 2003 (JP) ..... 2003-271098

(51) Int. Cl.
*A63B 49/10* (2006.01)

(52) U.S. Cl. ..... 473/535; 473/536; 473/537; 473/521

(58) Field of Classification Search ..... 473/524, 473/535–537, 520–521
See application file for complete search history.

(56) References Cited

U.S. PATENT DOCUMENTS 5,487,928 A * 1/1996 Fujimoto ..... 442/175
5,965,249 A * 10/1999 Sutton et al. ..... 428/304.4
6,335,100 B1 1/2002 Tominaga et al.
2003/0064838 A1* 4/2003 Ashino et al. ..... 473/535
2005/0003912 A1* 1/2005 Ashino et al. ..... 473/535
2005/0119075 A1* 6/2005 Ashino ..... 473/535

FOREIGN PATENT DOCUMENTS

JP 61-29613 B2 7/1986
JP 5-33645 B2 5/1993
JP 10-290851 A 11/1998
JP 2002-45444 A 2/2002

* cited by examiner

*Primary Examiner*—Raleigh W. Chiu
(74) *Attorney, Agent, or Firm*—Birch, Stewart, Kolasch & Birch, LLP

(57) ABSTRACT

A racket frame (10) including a laminate having not less than two fiber reinforced resinous layers layered one upon another and one or more modified fiber reinforced resinous layers (20) each containing a modified resinous composition, as a matrix resin, having a loss factor (=tan δ) not less than 0.5 nor more than 3.0, when the loss factor is measured at a temperature of 0° C. to 10° C. and a frequency of 10 Hz. A weight of the modified fiber reinforced resinous layers (20) is set to not less than 1% nor more than 10% of a weight of the fiber reinforced resinous layers.

13 Claims, 7 Drawing Sheets

RACKET FRAME

This nonprovisional application claims priority under 35 U.S.C. § 119(a) on Patent Application No(s). 2003-271098 filed in Japan on Jul. 4, 2003, the entire contents of which are hereby incorporated by reference.

BACKGROUND OF THE INVENTION

1. Field of the Invention

The present invention relates to a racket frame and more particularly to a racket frame formed by layering fiber reinforced resinous layers one upon another. In the present invention, a matrix resin which impregnates reinforcing fibers of the racket frame therewith is improved to allow the racket frame to be lightweight and have superior vibration-damping performance without deteriorating the strength and rigidity thereof.

2. Description of the Related Art

In playing tennis, vibrations generated when a player hits a tennis ball and shocks applied to the player's hand make the player uncomfortable and are considered to be a cause for tennis elbow. Therefore various devices have been made to suppress vibrations generated when the player hits the tennis ball. In a representative vibration-suppressing method, thermoplastic resins having a high vibration-damping performance are used as the matrix resin of the fiber reinforced resin composing the racket frame.

For example, in the racket proposed by the present applicant and disclosed in Japanese Patent Publication No. 5-33645, the thermoplastic resin consisting of the nylon resin having a high vibration-damping performance is used as the matrix resin. According to the disclosure, the vibration-damping ratio of this racket is about twice as high as that of a racket whose frame contains a thermosetting resin (for example, epoxy resin) as its matrix resin, supposing that the volume ratio of the fiber reinforcing the thermoplastic resin is equal to that of the fiber reinforcing the thermosetting resin.

As disclosed in Japanese Patent Application Laid-Open No. 10-290851, the present applicant also proposed the racket frame composed of the epoxy resinous composition containing the rubber-like polymeric component and the (meta) acrylic polymeric fine particles in a dispersed state. The racket frame has an improved vibration-damping performance without deterioration of its rigidity and strength and a low degree of fluctuations in its vibration-damping performance.

As disclosed in Japanese Patent Publication No. 61-29613, there is disclosed the prepreg containing the rubber-modified epoxy resin, having a sea-island structure, as its matrix resin. The epoxy resin and the liquid rubber compatible with the epoxy resin are hardened by uniformly compatibilizing the epoxy resin and the liquid rubber with each other.

As disclosed in Japanese Patent Application Laid-Open No. 2002-45444, the present applicant also proposed a racket frame having the viscoelastic material disposed at one or more positions of the fiber reinforced resinous layer thereof as the vibration-absorbing material. The viscoelastic material has a loss factor (=tan δ) not less than 1.00 and a thickness not less than 0.1 mm nor more than 0.6 mm, when the loss factor is measured at a temperature of 6° C. and a frequency of 10 Hz.

In the racket disclosed in Japanese Patent Publication No. 5-33645, the reason the nylon resin serving as the matrix resin has excellent vibration-damping performance is because water serves as a plasticizer and the glass transition temperature drops greatly. The glass transition temperature is about 60 degrees in an absolute dry state, but drops as the water absorption increases. Thus the glass transition temperature becomes about 20 degrees in the vicinity of the room temperature when the water absorption becomes 3%. Therefore the vibration-damping ratio of the racket is 0.005 in the absolute dry state, but 0.020 when the water absorption is saturated. That is, when a humidity changes, the performance of the racket changes. Thus although the vibration-damping performance of the racket can be enhanced, there is room for improvement in the degree of dependence on environment and making its weight lightweight.

In the racket frame disclosed in Japanese Patent Application Laid-Open No. 10-290851, although the racket frame has an excellent vibration-damping performance, the epoxy resinous composition containing the rubber-like polymeric component and the (meta) acrylic polymeric fine particles in a dispersed state has a high viscosity. Thus it is frequently difficult to mold the epoxy resinous composition. Further there is still room for improvement in making the weight of the racket frame lightweight and efficient realization of its vibration-damping performance.

Although the prepreg disclosed in Japanese Patent Publication No. 61-29613 has self-adhesion, it has a problem of incapable of enhancing the vibration-damping performance of the racket efficiently by making the racket lightweight and durable.

The rigidity of the racket frame may deteriorate owing to the influence of the viscoelastic material interposed between the adjacent fiber reinforced resins, which leads to the drop of its restitution coefficient. Thus the racket frame is demanded to improve its rigidity, strength, vibration-damping performance, and make it lightweight in a favorable balance.

SUMMARY OF THE INVENTION

The present invention has been made in view of the above-described problems. Therefore, it is an object of the present invention to provide a racket frame allowed to be lightweight without deteriorating its rigidity and strength and have an excellent vibration-damping performance.

To achieve the object, according to the present invention, there is provided a racket frame including a laminate having not less than two fiber reinforced resinous layers layered one upon another and one or more modified fiber reinforced resinous layers each containing a modified resinous composition, as a matrix resin, having a loss factor (=tan δ) not less than 0.5 nor more than 3.0, when the loss factor is measured at a temperature of 0° C. to 10° C. and a frequency of 10 Hz. The weight of the modified fiber reinforced resinous layers is set to not less than 1% nor more than 10% of the weight of the fiber reinforced resinous layers.

The modified fiber reinforced resinous layers each containing the modified resinous composition, as the matrix resin, are layered one upon another. The modified resinous composition has a loss factor (=tan δ) not less than 0.5 nor more than 3.0, when said loss factor is measured at a temperature of 0° C. to 10° C. and a frequency of 10 Hz. The weight of the modified fiber reinforced resinous layers is specified as described above. Therefore it is possible to make the racket frame lightweight owing to the use of the fiber reinforced resin, make the racket frame rigid owing to the use of the reinforcing fiber, and enhance the vibration-damping performance of the racket frame efficiently without deteriorating the strength of the racket frame.

If the loss factor is less than 0.5, it is impossible to improve the vibration-damping performance of the racket frame. On the other hand, if the loss factor is more than 3.0, the moldability and strength thereof are liable to deteriorate. It is more favorable that the loss factor of the modified resinous composition is not less than 1.0 nor more than 2.0. It is possible to layer two or more kinds of modified fiber reinforced resinous layers having different loss factors.

The reason the temperature is set to 0° C. to 10° C. is attributed to a rule of thumb of the measurement of viscoelasticity, namely, a frequency-temperature conversion rule. In the rule of thumb, it is considered that one order of frequency corresponds to 10° C. The frequency of the primary out-of-plane vibration of the racket frame is about 100 to 200 Hz. The frequency of the secondary out-of-plane vibration of the racket frame is about 400 to 500 Hz. The in-plane vibration of the racket frame is affected by the tension of strings and its frequency is about 300 to 800 Hz. Therefore attention is paid to 0° C. to 10° C. in consideration of the relationship between the room temperature at which the racket frame is used and the above-described frequency. The frequency of the forced vibration of the racket frame generated when a racket hits a ball is considered to be in the range of 100 to 1000 Hz. Thus by setting the tan δ measured in the above-described temperature range to not less than 0.5 nor more than 3.0, it is possible to efficiently suppress a force generated by an impact applied to the racket frame.

The reason the weight of the modified fiber reinforced resinous layer is set to not less than 1% nor more than 10% of the weight of the fiber reinforced resinous layer is as follows: If the weight of the modified fiber reinforced resinous layer is less than 1%, it is impossible to improve the vibration-damping performance of the racket frame. On the other hand, if the weight of the modified fiber reinforced resinous layer is more than 10%, the strength of the racket frame deteriorates.

According to the present invention, the vibration-damping performance can be improved not by disposing a material such as a vibration-damping material in the fiber reinforced resin but by using only a small amount of the modified fiber reinforced resinous layer whose matrix resin has been adjusted in its loss factor. Therefore it is possible to make the racket frame lightweight.

It is preferable to use a thermosetting resin as the resinous component of the modified resinous composition to make the strength and moldability of the entire racket frame. It is possible to set the loss factor to not less than 0.5 nor more than 3.0 by means of additives such as an activator, liquid rubber, a softener, and the like which increase a dipole moment amount. As the resinous component of the modified resinous composition, it is also possible to use a thermoplastic resin or a mixture of the thermosetting resin and the thermosetting resin.

The thermosetting resin is used as the resinous component of the matrix resin of the fiber reinforced resinous layer to prevent deterioration of the strength and rigidity of the racket frame, except the modified fiber reinforced resinous layer. The loss factor (=tan δ) of the modified resinous composition is set to favorably not less than 0.01 nor more than 0.5 and more favorably not less than 0.1 nor more than 0.3. Thereby the racket frame is allowed to have superior vibration-damping performance owing to the use of the modified fiber reinforced resinous layer, and the strength and rigidity of the racket frame can be enhanced. It is possible to use two or more kinds of thermosetting resins having different loss factors.

It is preferable that the modified resinous composition contains epoxy resin and one or more activators selected from a compound having benzotriazole groups and a compound having diphenyl acrylate groups specifically. DL26 produced by C.C.I. Inc., DL 30 and so on can be used as the modified resinous composition.

By mixing the activator with the epoxy resin, the epoxy resin is softened. Thereby it is possible to enhance the loss factor of the modified resinous composition and increase the dipole moment amount in the modified resinous composition. When the activator is dispersed in the modified resinous composition and compatibilized with the resinous component, electric charges of the positive and negative dipoles are attracted to each other and placed in a stable state, with the dipoles being electrically connected with the resinous component. When vibrations are applied to the modified resinous composition, the dipoles are displaced and separated from each other. Thereafter the dipoles have a restoring action of being attracted to each other again. At this time, the dipoles contact each other and high polymeric chains of the resinous component constituting the base of the modified resinous composition. Thereby a large quantity of a vibration energy is converted into a thermal energy as a friction energy. Owing to the above-described action, the vibration energy can be absorbed.

It is preferable that the molecules of the epoxy resin which is used for the modified resinous composition have long chains and a small number of side chains. It is also preferable that the equivalent weight of the epoxy resin is 250 to 350 and that its molecular weight is 500 to 700. Because such an epoxy resin has a small number of crosslinking points, the epoxy resin is capable of softening the modified resinous composition and increasing the loss factor.

A mixture of polypropylene-ether epoxy resin and G-glycidyl ether epoxy resin is particularly preferable. It is possible to use various epoxy resins in combination. The loss factor of the modified resinous composition can be adjusted in dependence on a mixing amount of the activator. It is preferable to mix 10 to 200 parts by weight of the activator with 100 parts by weight of the resinous component.

It is favorable that the tensile modulus of elasticity of the reinforcing fiber of the modified fiber reinforced resinous layer is set to not less than 150 GPa nor more than 600 GPa. If the tensile modulus of elasticity of the reinforcing fiber of the modified fiber reinforced resinous layer is less than 150 GPa, the rigidity of the racket frame deteriorates and its restitution performance is liable to deteriorate. The tensile modulus of elasticity of the reinforcing fiber of the modified fiber reinforced resinous layer is set to more favorably not less than 200 GPa and more favorably not less than 250 GPa. If the tensile modulus of elasticity of the reinforcing fiber of the modified fiber reinforced resinous layer is more than 600 GPa, the resistance to shock is liable to deteriorate. The tensile modulus of elasticity of the reinforcing fiber of the modified fiber reinforced resinous layer is set to more favorably not more than 500 GPa and most favorably not more than 450 GPa. The reinforcing fiber having a tensile modulus of elasticity in the above-described range is used at favorably not less than 50%, at more favorably not less than 75%, and most favorably at 100% of the entire fiber reinforced resinous layer.

It is preferable that the resinous component of the matrix resin of the normal fiber reinforced resinous layer is the same as that of the modified resinous composition. It is preferable that an epoxy resin for the normal fiber reinforced resinous layer has a smaller equivalent weight and a smaller molecular weight than the epoxy resin of the modified resinous composition. For example, a bisphenol A-type epoxy resin is preferable. Various additives may be added to the resinous component.

Supposing that the overall thickness of the laminate is 100%, one or more modified fiber reinforced resinous layers are disposed in a thickness range favorably not more than 20% of the overall thickness of the laminate and more favorably not more than 10% at both sides of the central position of the overall thickness.

When an impact is applied to the racket frame, the biggest shearing force is generated in the thickness range. Thus by disposing the modified fiber reinforced resinous layer having a high vibration-damping performance in the above-described thickness range, it is possible to damp vibrations generated by the racket frame efficiently.

Not less than 50% of the entire modified fiber reinforced resinous layer and more favorably 100% thereof is disposed in the above-described thickness range.

It is preferable that the racket frame includes a head part forming the outline of a ball-hitting face thereof and a bifurcated throat part connected to the head part. Supposing that the ball-hitting face is regarded as a clock surface and that the top position of the ball-hitting face is 12 o'clock, the modified fiber reinforced resinous layer is disposed at one position or two or more positions selected from among a first position in the range of 11 o'clock to one o'clock, a second position in the range of three o'clock to five o'clock (nine o'clock to seven o'clock), and a third position disposed at the left and right throat parts.

It is possible to improve the vibration-damping performance of the racket frame efficiently by disposing the modified fiber reinforced resinous layer at the above-described one position or at above-described two or more positions where vibrations in each of the primary out-of-plane vibration and the secondary out-of-plane vibration are excited to the highest extent.

In terms of the racket-handling performance and the balance thereof, it is preferable to dispose the modified fiber reinforced resinous layer at positions symmetrical in the left-to-right direction of the racket frame. It is preferable that the modified fiber reinforced resinous layer is disposed on the entire circumference of the racket frame in a sectional view thereof. The modified fiber reinforced resinous layer may be disposed partly or at a plurality of positions of the circumference of the racket frame in a sectional view thereof.

As the reinforcing fiber, fibers which are used as high-performance reinforcing fibers can be used. For example, it is possible to use carbon fiber, graphite fiber, aramid fiber, silicon carbide fiber, alumina fiber, boron fiber, glass fiber, aromatic polyamide fiber, aromatic polyester fiber, ultra-high-molecular-weight polyethylene fiber, and the like. Metal fibers may be used as the reinforcing fiber. These reinforcing fibers can be used in the form of long or short fibers. A mixture of two or more of these reinforcing fibers may be used. The configuration and arrangement of the reinforcing fibers are not limited to specific ones. For example, they may be arranged in a single direction or a random direction. The reinforcing fibers may have the shape of a sheet, a mat, fabrics (cloth), braids, and the like.

Carbon fiber is preferable as the reinforcing fiber of the modified fiber reinforced resinous layer, because the carbon fiber has a high strength and a low specific gravity. It is preferable that the carbon fiber is used at favorably not less than 50%, more favorably not less than 75%, and most favorably 100% of the entire fiber reinforced resinous layer.

The fiber reinforced resinous layer is formed as a structure of prepregs layered one upon another; a structure of fibers impregnated with resin and layered one upon another by a filament winding method (FW method); or a structure of fibers layered one upon another by the FW method and impregnated with the resin.

By composing the fiber reinforced resinous layer of the prepregs, it is possible to improve the vibration-damping performance of the racket frame with its restitution performance maintained, without deteriorating the rigidity thereof.

The racket frame of the present invention can be suitably used as a racket frame, for a racket of regulation-ball tennis, having a weight not less than 180 g nor more than 305 g. In addition, the racket frame of the present invention can be suitably used for a racket of softball tennis, badminton, and squash.

The loss factor (=tan δ) is measured by a viscosity-measuring apparatus (manufactured by Rheology Inc.) As the measuring condition, frequency: 10 Hz, temperature: 0° C. to 10° C., tool stretch; rate of temperature increase: 2° C./minute, initial strain: 2 mm, and displacement amplitude: ±12 μm. The dimension of a specimen is that the width is 5 mm, the thickness is 2 mm, and the length is 30 mm. The specimen is chucked in the length of 5 mm at its both ends. Thus the displacement portion of the specimen is 20 mm.

It is preferable to add an activator and a hardening agent used to harden the thermosetting resin such as epoxy resin to the thermosetting resin and heat the mixture to compatibilize the activator with the thermosetting resin.

In addition, the following agents may be added to the thermosetting resin as necessary: setting-accelerating agent, plasticizer, stabilizer, emulsifying agent, filler, reinforcing agent, colorant, foaming agent, antioxidant, ultraviolet prevention agent, and lubricant.

The racket frame of the present invention is formed by the following methods (1) through (3):

(1) Carbon fibers are wound around a drum at predetermined angles with the carbon fibers kept immersed in the modified resinous composition containing the epoxy resin as its main component and having a loss factor (=tan δ) not less than 0.5 nor more than 3.0 or in the normal resinous composition containing the epoxy resin as its main component and having a loss factor (=tan δ) not less than 0.01 nor more than 0.5. After a predetermined amount of the carbon fibers is wound around the drum, an extra portion thereof is cut off. Thereafter the carbon fibers impregnated with the resin are heated at 80° C. to 100° C. to form prepregs in a pseudo-hardened state. The prepregs are cut with the prepregs layered one upon another at predetermined angles. After a mandrel having a certain thickness is inserted into a tube made of nylon or silicon, the prepregs are wound on the tube at predetermined positions respectively in such a way that the reinforcing fibers of the prepregs form predetermined angles and have predetermined fibrous amounts respectively. After the tube on which the prepregs have been wound are removed from the mandrel, the tube is set in a die for the racket frame. After an appropriate pressure is applied to the inside of the tube to contact the tube and the reinforcing fibers with the inner surface of the die, the die is heated at 150° C. for 15 minutes to harden the prepregs.

(2) By the filament-winding method, the fibers impregnated with a proper amount of the modified resinous Composition or the ormal resinous composition are wound at predetermined angles around the tube through which the mandrel has been inserted. After the fiber-wound tube is removed from the mandrel, the fiber-wound tube is set in the die for the racket frame. Thereafter the die is heated, similarly to the method described in the above (1).

(3) After blades formed by knitting fibers are immersed in the modified resinous composition or in the normal resinous composition, the blades are wound around a tube, made of nylon or silicon, into which a mandrel having a certain thickness has been inserted. Thereafter the prepregs are wound around the tube by layering them one upon another to form a cylindrical layup. Then the layup disposed around the tube is removed from the mandrel and set in the die for the racket frame.

As apparent from the foregoing description, the modified fiber reinforced resinous layers each containing the modified resinous composition, as the matrix resin, are layered one upon another. The modified resinous composition has a loss factor (=tan δ) not less than 0.5 nor more than 3.0, when said loss factor is measured at a temperature of 0° C. to 10° C. and a frequency of 10 Hz. The weight of the modified fiber reinforced resinous layers is specified as described above. Therefore it is possible to make the racket frame lightweight owing to the use of the fiber reinforced resin, make the racket frame rigid owing to the use of the reinforcing fiber, and enhance the vibration-damping performance of the racket frame efficiently without deteriorating strength of the racket frame.

According to the present invention, the vibration-damping performance can be improved not by disposing a material such as a vibration-damping material in the fiber reinforced resin but by using only a small amount of the modified fiber reinforced resinous layer. Therefore it is possible to make the racket frame lightweight. Therefore it is possible to use the racket frame suitably for various rackets such as a racket for regulation-ball tennis.

DETAILED DESCRIPTION OF THE PREFERRED EMBODIMENTS

The embodiments of the present invention will be described below with reference to the drawings.

Figure 1:
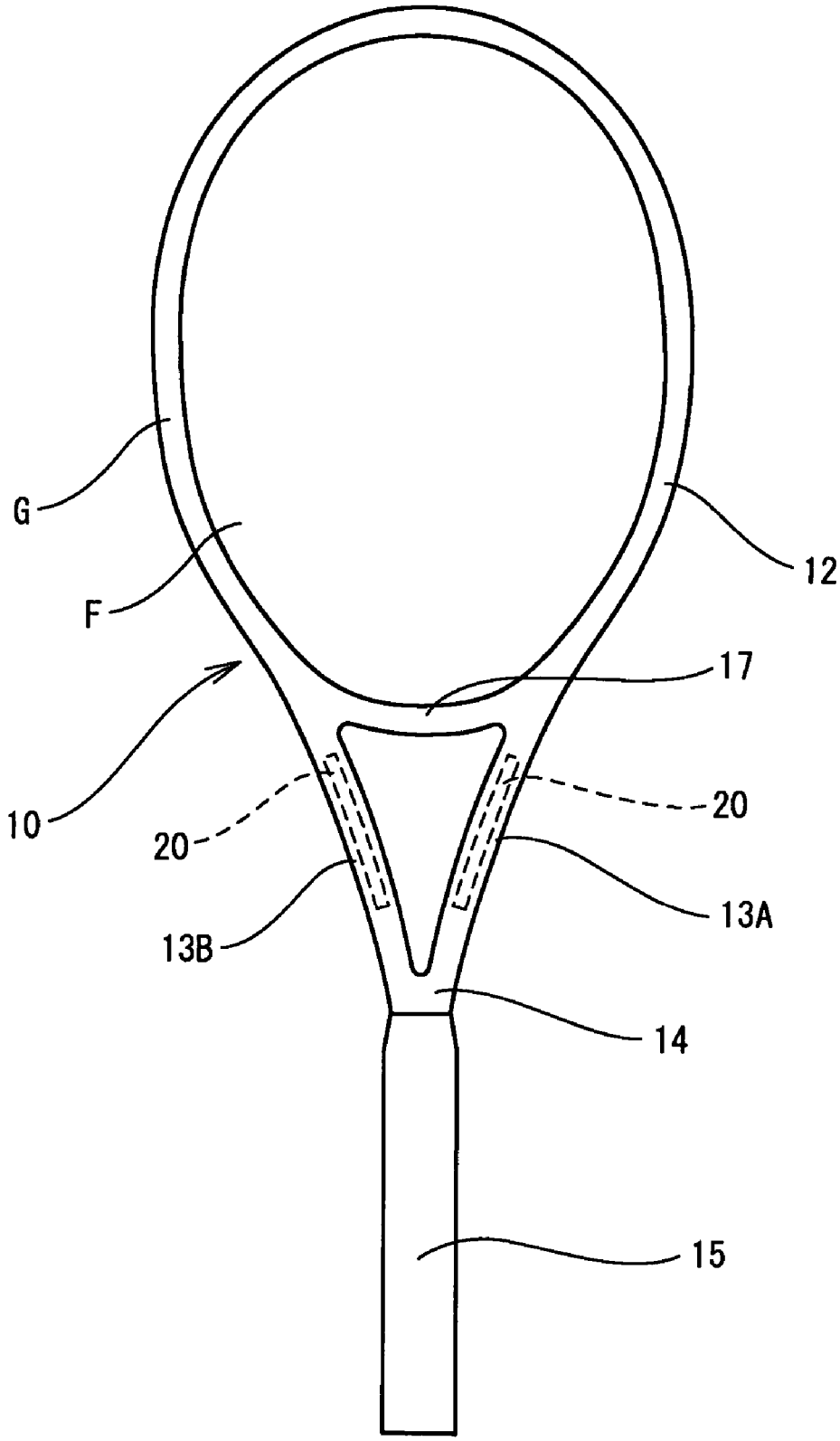
FIG. 1 is a schematic front view showing a racket frame of the present invention.
Figure 2A:
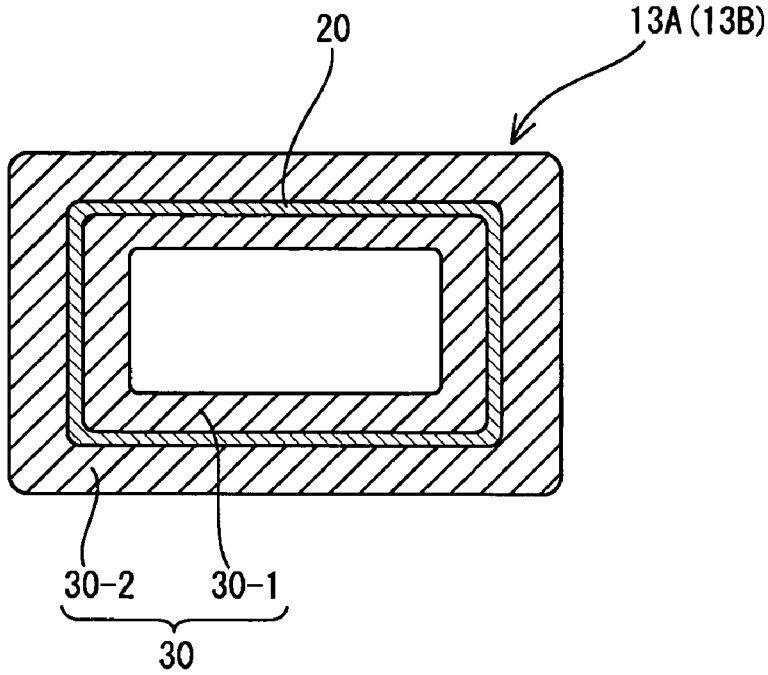
FIG. 2A is a sectional view showing a throat part in which modified fiber reinforced resinous layers are layered one upon another.
Figure 2B:
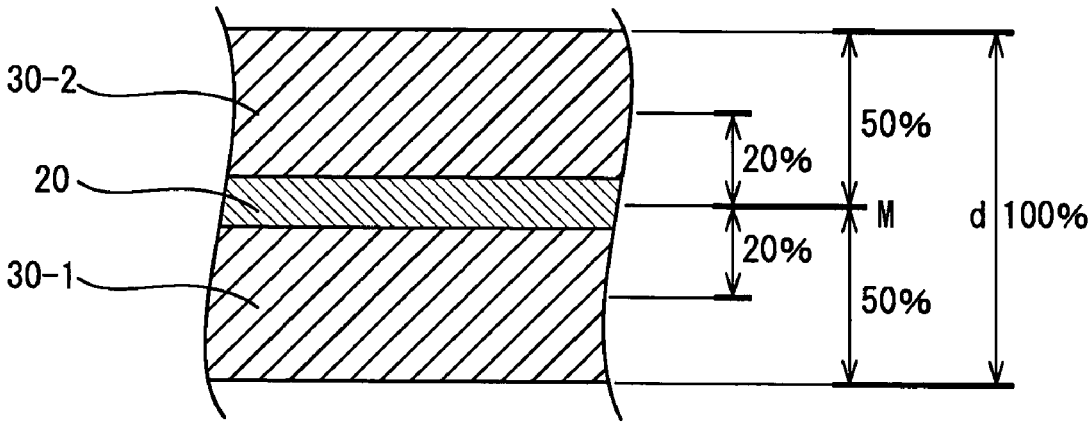
FIG. 2B is an explanatory view showing a layered situation of the modified fiber reinforced resinous layers.

FIGS. 1 and 2 show a racket frame 10 according to a first embodiment of the present invention.

The racket frame 10 is composed of a hollow pipe-shaped laminate including two or more fiber reinforced resinous layers.

The racket frame 10 has a head part 12 forming the outline of a ball-hitting face F, bifurcated throat parts 13A, 13B connected to the head part 12, a shaft part 14, and a grip part 15. These parts 12, 13A, 13B, 14, and 15 are integrally formed. One end of a yoke 17 is connected to the throat part 13A, and the other end thereof is connected to the throat part 13B so that the yoke 17 and the head part 12 form a string-stretching part G surrounding a ball-hitting face F. String-stretching string holes (not shown in FIGS. 1 and 2) are formed on the string-stretching part G.

In the first embodiment, a modified fiber reinforced resinous layer 20 containing a modified resinous composition, as its matrix resin, having 1.3 as its loss factor (=tan δ) measured at a temperature of 0° C. to 10° C. and a frequency of 10 Hz is disposed at each of the left and right throat parts 13A, 13B. The weight of the modified fiber reinforced resinous layer 20 is 1% of the weight of a normal fiber reinforced resinous layer 30. The loss factor (=tan δ) of the matrix resin of the normal fiber reinforced resinous layer 30 is set to 0.2.

At the position of the modified fiber reinforced resinous layer 20, 10 prepregs of the normal fiber reinforced resinous layer 30 are layered one upon another. Layered prepregs of the modified fiber reinforced resinous layer 20 are disposed between a fourth-layer prepreg of the normal fiber reinforced resinous layer 30 and a fifth-layer prepreg thereof.

More specifically, the modified fiber reinforced resinous layer 20 is so disposed as to make the thickness of an inner prepreg 30-1 of the first to fourth layer of the normal fiber reinforced resinous layer 30 equal to the thickness of an outer prepreg 30-2 of the fifth to tenth layer of the normal fiber reinforced resinous layer 30. Supposing that the overall thickness d of the laminate is 100%, the modified fiber reinforced resinous layer 20 is disposed at not more than 20% of the overall thickness d on both sides of a central position M in the overall thickness d. The modified fiber reinforced resinous layer 20 is disposed on the entire circumference of the racket frame 10 in a sectional view thereof.

Carbon fibers having a tensile modulus of elasticity of 200 to 500 GPa are used as the reinforcing fibers of the modified fiber reinforced resinous layer 20 and the normal fiber reinforced resinous layer 30. The angles of the reinforcing fibers with respect to the axis of the pipe-shaped laminate composing the racket frame 10 are set to 0°, 90°, 30°, 22°, and 45°.

The modified resinous composition contains an epoxy resin and one or more activators selected from a compound having benzotriazole groups and a compound having diphenyl acrylate groups. More specifically, an epoxy resin formed by mixing polypropylene-ether epoxy resin with G-glycidyl ether epoxy resin is used as the modified resinous composition. The epoxy resin has 296 in its tensile modulus of elasticity and 592 in its molecular weight.

Bisphenol A-type epoxy resin is used as the resinous component of the normal resinous composition. The bisphenol A-type epoxy resin has 190 to 200 in its epoxy equivalent weight and 380 to 400 in its molecular weight. The normal resinous composition contains no activators.

The method of forming the racket frame 10 from the modified fiber reinforced resinous layer 20 and the normal fiber reinforced resinous layer 30 is described below.

The carbon fibers are wound around a drum at predetermined angles with the carbon fibers being immersed in the modified resinous composition or the normal resinous composition. After a predetermined amount of the carbon fibers is wound around the drum, an extra portion thereof is cut off. Thereafter the carbon fibers are heated at 80° C. to 100° C. to form prepregs in a pseudo-hardened state. The prepregs are cut with the prepregs layered one upon another at predetermined angles.

After a mandrel is inserted into a tube made of nylon, the prepregs are wound on the tube at predetermined layering positions respectively in such a way that the reinforcing fibers of the prepregs form predetermined angles and have predetermined fibrous amounts respectively. After the tube on which the prepregs have been wound are removed from the mandrel, the tube on which the prepregs have been wound is set in a die for the racket frame. After an appropriate pressure is applied to the inside of the tube to contact the tube and the reinforcing fibers with the inner surface of the die. Then the die is heated at 1500 for 15 minutes to harden the prepregs. In this manner, the racket frame 10 is formed.

In the racket frame 10, the modified fiber reinforced resinous layer 20 containing the modified resinous composition, as its matrix resin, having 1.3 as a loss factor (=tan δ) thereof is disposed at each of the left and right throat parts 13A, 13B.

The weight of the modified fiber reinforced resinous layer 20 is 1% of the weight of the normal fiber reinforced resinous layer 30. Therefore it is possible to make the racket frame lightweight owing to the use of the fiber reinforced resin, make the racket frame rigid owing to the use of the reinforcing fibers, and enhance the vibration-damping performance of the racket frame efficiently without deteriorating strength of the racket frame.

Figure 3:
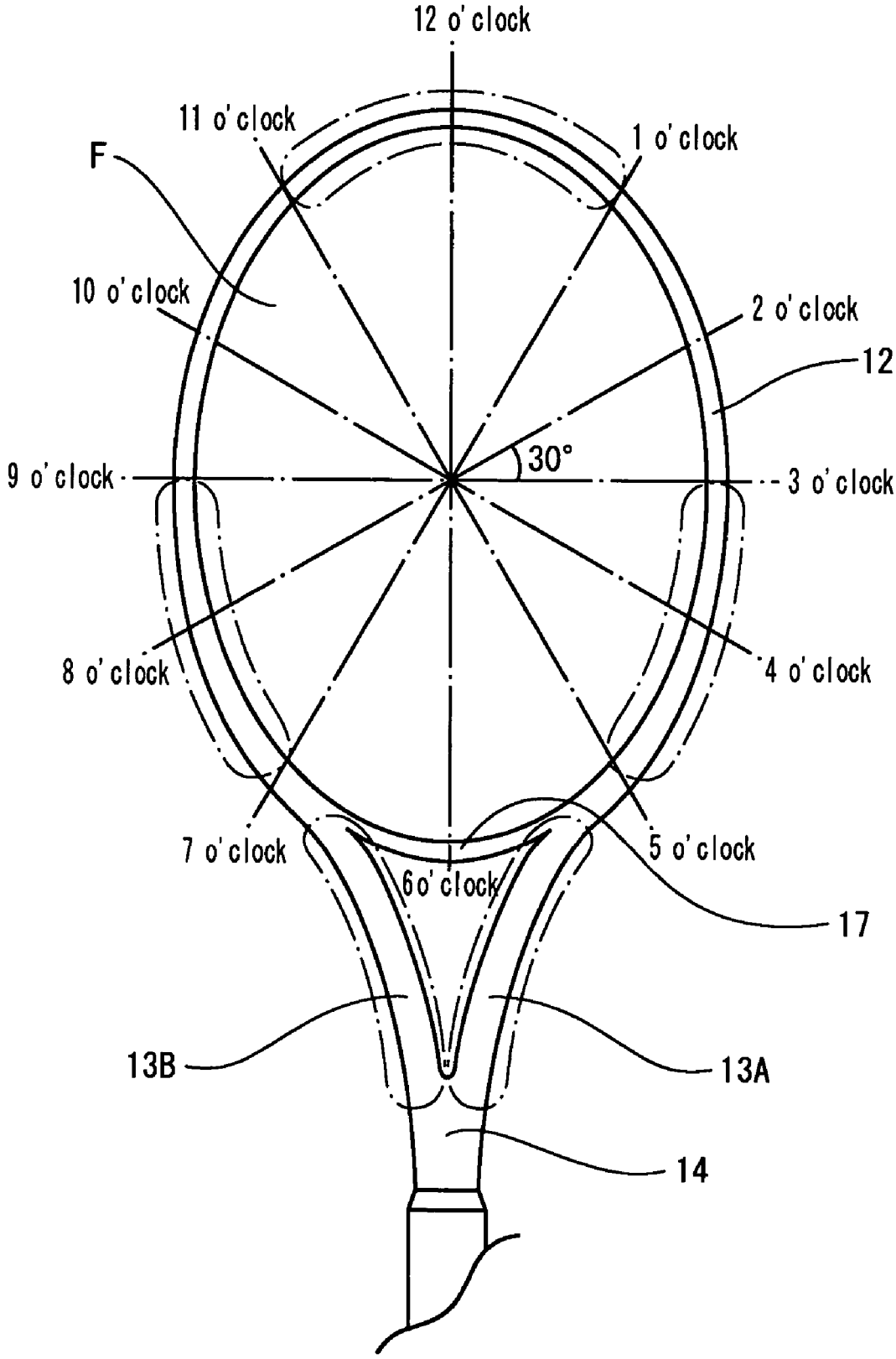
FIG. 3 shows positions where the modified fiber reinforced resinous layers are disposed.

In the first embodiment, the disposition of the modified fiber reinforced resinous layer 20 is not limited to the left and right throat parts 13A, 13B. As shown in FIG. 3, supposing that the ball-hitting face F is regarded as a clock surface and that the top position of the ball-hitting face F is 12 o'clock, it is preferable to dispose the modified fiber reinforced resinous layer 20 at one position or two or more positions selected from among a first position in the range of 11 o'clock to one o'clock, a second position in the range of three o'clock to five o'clock (nine o'clock to seven o'clock), and a third position disposed at the left and right throat parts.

The modified fiber reinforced resinous layer 20 may be disposed at positions other than the above-described positions.

Figure 4:
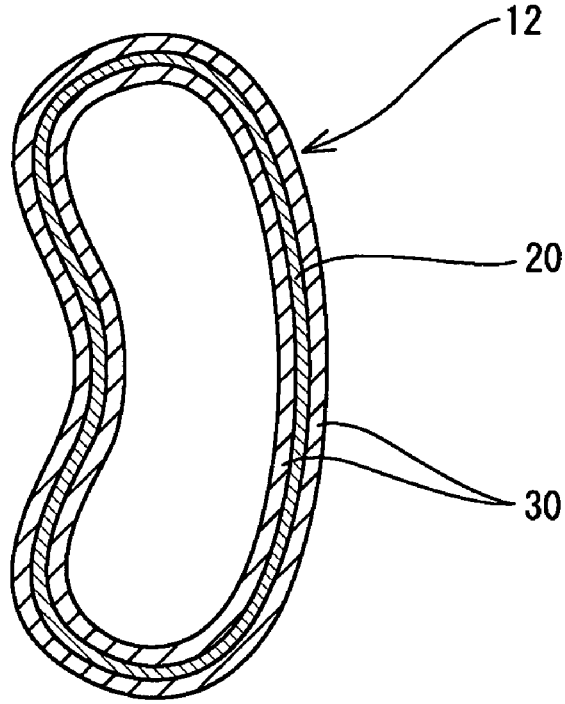
FIG. 4 is a sectional view showing a head part in which the modified fiber reinforced resinous layers are layered one upon another.

In addition to the throat part, as shown in FIG. 4, the modified fiber reinforced resinous layer 20 can be disposed between the adjacent normal fiber reinforced resinous layers 30 at the four o'clock position or the like included in the head part 12 where strings are stretched.

Figure 5:
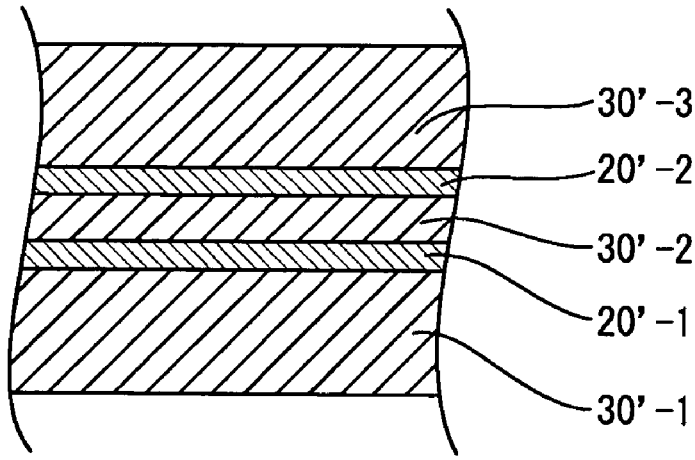
FIG. 5 shows a mode in which two modified fiber reinforced resinous layers are layered.

As shown in FIG. 5, the prepregs can be layered one upon another by alternating two modified fiber reinforced resinous layers 20'-l, 20'-2 with three normal fiber reinforced resinous layers 30'-1, 30'-2, and 30'-3. In addition, the number of the modified fiber reinforced resinous layers can be set to not less than three.

The loss factor of the modified resinous composition can be adjusted in dependence on the kind of additives such as resin, activator, liquid rubber, softener, and the like. It is also possible to set the configuration, thickness, and number of turns of the prepreg appropriately.

The racket frames of the examples of the present invention and comparison examples will be described in detail below.

The frame body of each of the examples and the comparison examples was made of fiber reinforced resinous layer and hollow. A racket having each racket frame had an overall length of 27.5 inches, a maximum thickness of 24 mm, a width of 12 mm, and a ball-hitting area of 110 square inches. The racket frames were formed by the method described below.

Prepreg sheets (CF prepreg (T300, T700, T800, M46J manufactured by Toray Industries Inc.) composed of a thermosetting resin reinforced with carbon fibers were layered one upon another on a mandrel (ϕ 14.5 mm) on which an internal-pressure tube made of nylon 66 was fitted. Thereby a cylindrical laminate was formed. The prepreg sheets were layered one upon another at angles of 0°, 22°, 30°, and 90° with respect to the axis of the laminate. After the mandrel was removed from the laminate, the laminate was set on a die. After the die was clamped, the die was heated to 150° C. for 30 minutes, with an air pressure of 9 kgf/cm$^2$ kept applied to the inside of the inner-pressure tube.

The weight (mass obtained by excluding the weight of string) and the balance were as shown in table 1.

TABLE 1-1

| | | Example 1 | Example 2 | Example 3 | Example 4 | Example 5 | Example 6 |
|---|---|---|---|---|---|---|---|
| Modified resin | tan δ measured at 10° C. and 10 Hz | 1.3 | 1.3 | 1.3 | 1.3 | 1.3 | 1.3 |
| | Weight (g) of inserted modified layer | 2 | 2 | 2 | 6 | 4 | 20 |
| | Percentage of weight of modified layer to weight of normal layer | 1 | 1 | 1 | 3 | 2 | 10 |
| | Number of normal layers | 10 | 10 | 10 | 10 | 10 | 10 |
| | Position of modified layer | Between fourth and fifth layers | Between fourth and fifth layers | Between fourth and fifth layers | Between third and fourth layers<br>Between fourth and fifth layers<br>Between fifth and sixth layers | Between fourth and fifth layers | Between fourth and fifth layers |
| | Position of inserted modified layer | Throat part | 4 o'clock (8 o'clock) | Top | Throat part | 4 o'clock (8 o'clock), throat part | Top to throat |

TABLE 1-1-continued

| | | | Example 1 | Example 2 | Example 3 | Example 4 | Example 5 | Example 6 |
|---|---|---|---|---|---|---|---|---|
| Weight (g)/balance (mm) | | | 267/335 | 267/336 | 267/338 | 271/335 | 269/337 | 285/340 |
| Rigidity | Ball-hitting face/side surface (kg/cm) | | 180/90 | 178/89 | 177/88 | 175/86 | 176/87 | 174/85 |
| Vibration | Primary out-of-plane | Frequency | 212 | 212 | 211 | 213 | 211 | 211 |
| | | Vibration-damping factor | 0.63 | 0.75 | 0.81 | 1.35 | 0.86 | 2.51 |
| | Secondary out-of-plane | Frequency | 555 | 554 | 558 | 556 | 555 | 554 |
| | | Vibration-damping factor | 0.72 | 0.71 | 0.70 | 1.23 | 0.84 | 2.68 |
| Durability test | | | ○ | ○ | ○ | ○ | ○ | ○ |
| Evaluation of vibration-absorbing performance by hitting ball | | | 3.9 | 3.9 | 3.9 | 4.2 | 4.0 | 4.6 |

TABLE 1-2

| | | | Comparison Example 1 | Comparison Example 2 | Comparison Example 3 |
|---|---|---|---|---|---|
| Modified resin | tan δ measured at 10° C. and 10 Hz | | — | 0.2 | 1.3 |
| | Weight (g) of inserted modified layer | | — | 2 | 26 |
| | Percentage of weight of modified layer to weight of normal layer | | — | 1 | 13 |
| | Number of normal layers | | 10 | 10 | 10 |
| | Position of modified layer | | — | Between fourth and fifth layers | Between fourth and fifth layers |
| | Position of inserted modified layer | | — | Throat part | Top to grip part |
| Weight (g)/balance (mm) | | | 265/335 | 267/335 | 291/342 |
| Rigidity | Ball-hitting face/side surface (kg/cm) | | 180/90 | 180/90 | 175/89 |
| Vibration | Primary out-of-plane | Frequency | 214 | 213 | 210 |
| | | Vibration-damping factor | 0.31 | 0.32 | 2.68 |
| | Secondary out-of-plane | Frequency | 554 | 552 | 551 |
| | | Vibration-damping factor | 0.42 | 0.42 | 2.84 |
| Durability test | | | ○ | ○ | X |
| Evaluation of vibration-absorbing performance by hitting ball | | | 2.5 | 2.5 | 4.8 |

EXAMPLE 1

The specification of the racket frame of the example 1 was similar to that of the first embodiment.

One modified fiber reinforced resinous layer containing the above-described modified resinous composition, having the loss factor of 1.3, as the matrix resin thereof was disposed on the mandrel. Two grams of a prepreg (6 cm×8 cm×0.2 mm) composing the modified fiber reinforced resinous layer was disposed on the left and right throat parts.

The modified fiber reinforced resinous layer was disposed between the normal fiber reinforced resinous layers containing the normal resinous composition, having the loss factor of 0.2, as the matrix resin thereof. More specifically, the modified fiber reinforced resinous layer was disposed between the fourth layer and fifth layer of 10 prepregs composing the normal fiber reinforced resinous layer.

DL26 produced by C.C.I. Inc. was used as the modified resinous composition containing epoxy resin formed by mixing polypropylene-ether epoxy resin with G-glycidyl ether epoxy resin and one or more activators selected from a compound having a benzotriazole group and a compound having diphenyl acrylate group.

Epicoat 828, produced by Japan Epoxy Resin Inc., which is bisphenol A-type epoxy resin was used as the normal resinous composition.

The tensile modulus of elasticity of the carbon fibers was set to 200 to 500 GPa.

EXAMPLE 2

The insertion position of the modified fiber reinforced resinous layer was the four o'clock position of the head part and the eight o'clock position thereof. The other specifications of the racket frame were similar to those of the example 1.

EXAMPLE 3

The insertion position of the modified fiber reinforced resinous layer was the top position (12 o'clock) of the head part. The other specifications of the racket frame were similar to those of the example 1.

EXAMPLE 4

Three modified fiber reinforced resinous layers were layered one upon another. More specifically, the modified fiber reinforced resinous layers were disposed between the third and fourth layers of 10 prepregs composing the normal fiber reinforced resinous layer, between the fourth and fifth layers thereof, and between the fifth and sixth layers thereof. The weight of the modified fiber reinforced resinous layer was 6 g. The other specifications of the racket frame were similar to those of the example 1.

EXAMPLE 5

The insertion position of the modified fiber reinforced resinous layer was the left and right throat parts, the four o'clock position of the head part, and the eight o'clock position thereof. The weight of the modified fiber reinforced resinous layer was 6 g. The other specifications of the racket frame were similar to those of the example 1.

EXAMPLE 6

The insertion position of the modified fiber reinforced resinous layer was from the top position of the head part to each of the left and right throat parts. The weight of the modified fiber reinforced resinous layer was 20 g. The other specifications of the racket frame were similar to those of the example 1.

COMPARISON EXAMPLE 1

The modified fiber reinforced resinous layer was not used, but 10 prepregs composing the normal fiber reinforced resinous layers were used. The other specifications of the racket frame were similar to those of the example 1.

COMPARISON EXAMPLE 2

Instead of the modified fiber reinforced resinous layer of the example 1, the normal fiber reinforced resinous layer containing the normal resinous composition, having the loss factor of 0.2, as the matrix resin thereof was inserted into the left and right throat parts. The weight of the normal fiber reinforced resinous layer was 2 g. The other specifications of the racket frame were similar to those of the example 1.

COMPARISON EXAMPLE 3

The insertion position of the modified fiber reinforced resinous layer was in the range from the top position of the head part to the grip part. The weight of the modified fiber reinforced resinous layer was 26 g. The other specifications of the racket frame were similar to those of the example 1.

The racket frame of each of the examples and the comparison examples was measured on the rigidity of its ball-hitting face, the rigidity of its side surface, its primary out-of-plane vibration-damping factor, and its secondary out-of-plane vibration-damping factor by a method described later. A durability test of each racket frame was conducted. Further, evaluation was made on vibration-absorbing performance of each racket frame by hitting balls with each racket.

Measurement of Rigidity of Ball-Hitting Plane

Figure 6A:
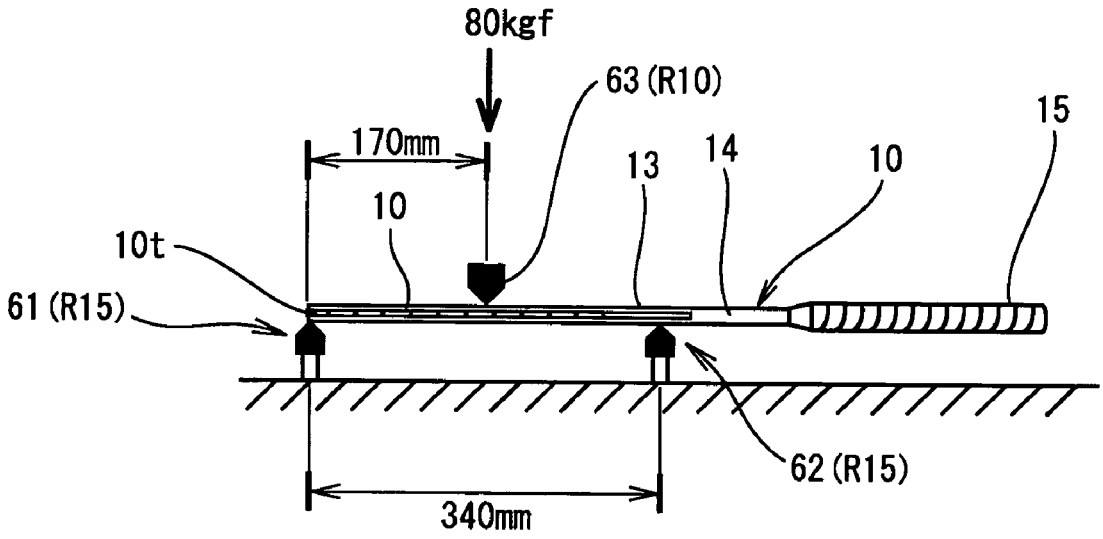
FIG. 6A is a schematic front view showing a method of measuring the rigidity of a ball-hitting plane.
Figure 6B:
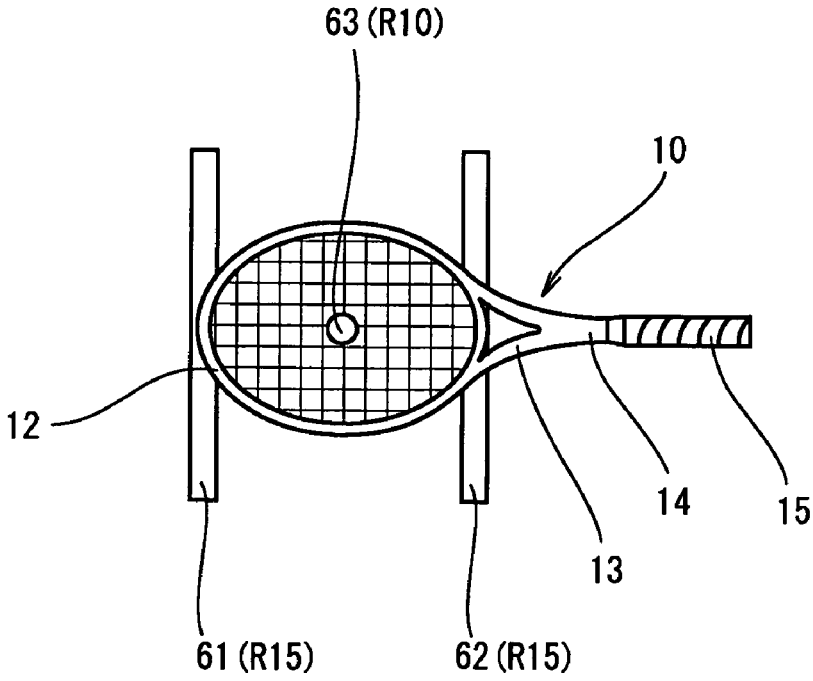
FIG. 6B is a schematic plan view showing the method of measuring the rigidity of the ball-hitting plane.

As shown in FIGS. 6A and 6B, the string-stretched racket frame 10 of each of the examples and the comparison examples was horizontally disposed. The top position of the head part 12 was supported by a receiving tool 61 (R15). A position, spaced by 340 mm from the top position, which was located in the range between the throat pats 13 and the yoke 14 was supported by a receiving tool 62 (R15). In this state, a load of 80 kgf was applied downward to a position spaced by 170 mm from the position of the tool 61 by means of a pressurizing instrument 63 (R10). The applied load of 80 kgf was divided by a displaced amount (flexed amount) of the ball-hitting plane to obtain the rigidity value thereof in the out-of-plane direction.

Measurement of Rigidity Value of Side Surface

Figure 7:
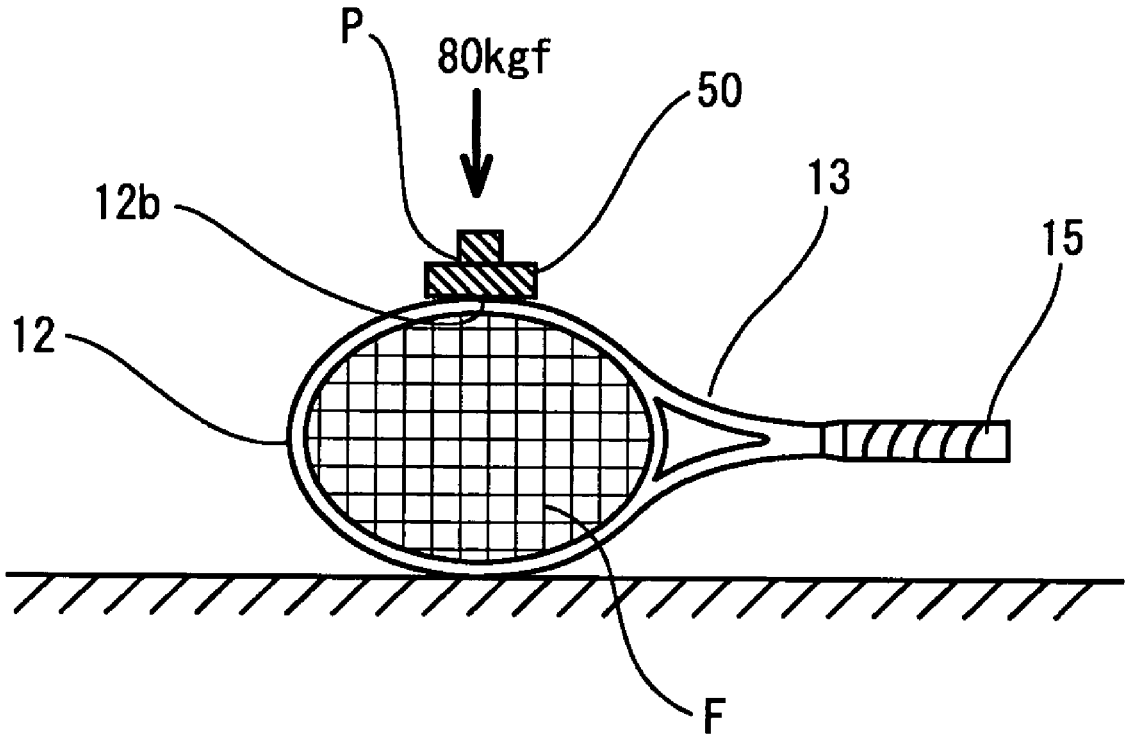
FIG. 7 is a schematic view showing a method of measuring the rigidity of a side surface of the racket frame.

As shown in FIG. 7, the tennis racket of each of the examples and the comparison examples was held sideways with a ball-hitting plane F kept vertical. In this state, a load of 80 kgf was applied to an upper side surface 12*b* of the head part 12 by means of a flat plate P. The applied load of 80 kgf was divided by a displaced amount (flexed amount) of the side surface 12*b* to obtain the rigidity value thereof in the in-plane direction.

Measurement of Primary Out-of-Plane Vibration Damping Factor

Figure 8A:
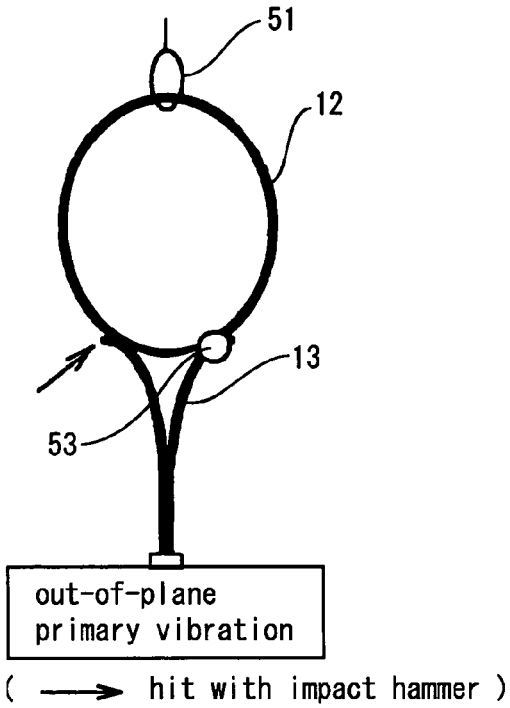
FIGS. 8A through 8C are schematic views showing the method of measuring the vibration-damping factor of the racket frame.

As shown in FIG. 8A, the upper end of the head part 12 of the tennis racket of each of the examples and the comparison examples was hung with a cord 51. An acceleration pick-up meter 53 was mounted on one connection portion between the head part 12 and the throat part 13, with the acceleration pick-up meter 53 perpendicular to the face of the racket frame. As shown in FIGS. 8B, in this state, the other connection portion between the head part 12 and the throat part 13 was hit with an impact hammer 55 to vibrate the racket frame. An input vibration (F) measured by a force pick-up meter mounted on the impact hammer 55 and a response vibration ($\alpha$) measured by the acceleration pick-up meter 53 were inputted to a frequency analyzer 57 (dynamic single analyzer HP3562A manufactured by Fuhret Packard Inc.) through amplifiers 56A and 56B. A transmission function in a frequency region obtained by an analysis was calculated to obtain the frequency of the tennis racket. The vibration-damping ratio ($\zeta$) of the tennis racket, namely, the primary out-of-plane vibration-damping factor thereof was computed by an equation shown below. Table 1 shows the primary out-of-plane vibration-damping factor of the tennis racket of each of the examples and the comparison examples as the average value.

$$\zeta=(1/2)\times(\Delta\omega/\omega n)$$

$$To=Tn/\sqrt{2}$$

Measurement of Secondary Out-of-Plane Vibration-Damping Factor

Figure 8C:
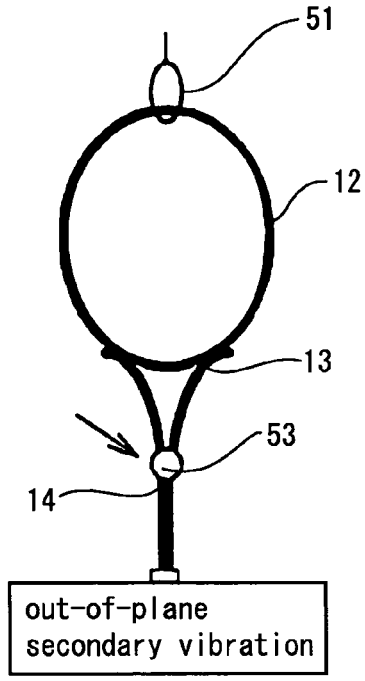
Figure 8B:
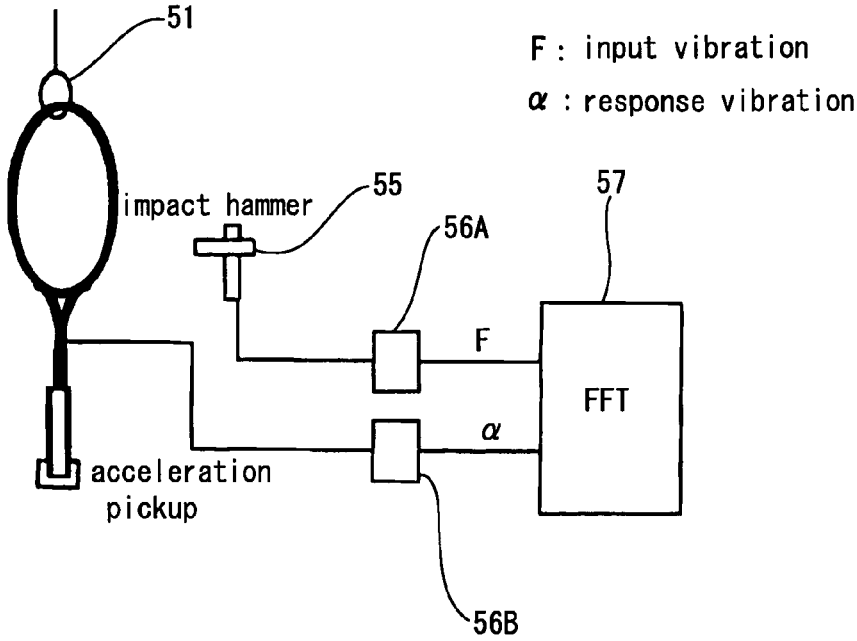

As shown in FIG. 8C, the upper end of the head part 12 of the tennis racket of each of the examples and the comparison examples was hung with the cord 51. The acceleration pick-up meter 53 was mounted on one connection portion between the throat part 13 and the shaft part 14, with the acceleration pick-up meter 53 perpendicular to the face of the racket frame. In this state, the rear side of a pick-up meter-installed position was hit with the impact hammer 55 to vibrate the tennis racket. The vibration-damping factor, namely, the secondary out-of-plane vibration-damping factor of the tennis racket was computed by a method equivalent to the method of computing the primary out-of-plane vibration-damping factor. Table 1 shows the secondary out-of-plane vibration-damping factor of the tennis racket of each of the examples and the comparison examples as the average value.

Durability Test

A ball was hit against each racket frame at a position spaced by 18 cm from the top of the ball-hitting face thereof to check the durability thereof, namely, whether the racket frame was broken by an impact applied thereto.

Evaluation by Ball-Hitting Test

Questionnairing was conducted on the vibration-absorbing performance of each racket. Fifty middle and high class female players (who have not less than 10 year' experience and play tennis three or more days a week currently) hit balls with the tennis rackets and gave marks on the basis of five (the more, the better). Table 1 shows the average of marks they gave.

As shown in table 1, the racket frame of each of the examples 1 through 6 was composed of the modified fiber reinforced resinous layers each containing the modified resinous composition, as its matrix resin, having a loss factor of 1.3. It could be confirmed that the racket frames had high primary and secondary out-of-plane vibration-damping factor, were excellent in the evaluation of the ball-hitting test, and had an excellent vibration-damping performance without deteriorating the rigidity and strength thereof.

On the other hand, because the racket frame of each of the comparison examples 1 and 2 did not contain the modified fiber reinforced resinous layer, each racket frame had a low vibration-damping factor and was unfavorable in the evaluation of the ball-hitting test. Although the racket frame of the comparison example 3 contained the modified fiber reinforced resinous layer at as high as 13% of the entire weight of the normal fiber reinforced resinous layer, it had a low strength and was broken in the durability test.

What is claimed is:

1. A racket frame comprising a laminate including not less than two fiber reinforced resinous layers layered one upon another and one or more modified fiber reinforced resinous layers each containing a modified resinous composition, as a matrix resin, having a loss factor (=tan δ) not less than 0.5 nor more than 3.0 when said loss factor is measured at a temperature of 0° C. to 10° C. and a frequency of 10 Hz, wherein a weight of said modified fiber reinforced resinous layers is set to not less than 1% nor more than 10% of a weight of said fiber reinforced resinous layers.

2. The racket frame according to claim 1, wherein supposing that an overall thickness of said laminate is 100%, one or more said modified fiber reinforced resinous layers are disposed in a thickness range not more than 20% of said overall thickness of said laminate at both sides of a central position of said thickness.

3. The racket frame according to claim 2, wherein a thermosetting resin is used as a resinous component of said modified resinous composition; said thermosetting resin is used as a resinous component of said of a matrix resin of said fiber reinforced resinous layer; and said loss factor (=tan δ) of said modified resinous composition is set to not less than 0.01 nor more than 0.5.

4. The racket frame according to claim 3, wherein said modified resinous composition contains epoxy resin and one or more activators selected from a compound having benzotriazole groups and a compound having diphenyl acrylate groups; and a tensile modulus of elasticity of a reinforcing fiber of said modified fiber reinforced resinous layer is set to not less than 150 GPa nor more than 600 GPa.

5. The racket frame according to claim 3, comprising a head part forming an outline of a ball-hitting face thereof and a bifurcated throat part connected to said head part, wherein supposing that said ball-hitting face is regarded as a clock surface and that a top position of said ball-hitting face is 12 o'clock, said modified fiber reinforced resinous layer is disposed at one position or two or more positions selected from among a first position in a range of 11 o'clock to one o'clock, a second position in a range of three o'clock to five o'clock (nine o'clock to seven o'clock), and a third position disposed at said left and right throat parts.

6. The racket frame according to claim 2, wherein said modified resinous composition contains epoxy resin and one or more activators selected from a compound having benzotriazole groups and a compound having diphenyl acrylate groups; and a tensile modulus of elasticity of a reinforcing fiber of said modified fiber reinforced resinous layer is set to not less than 150 GPa nor more than 600 GPa.

7. The racket frame according to claim 2, comprising a head part forming an outline of a ball-hitting face thereof and a bifurcated throat part connected to said head part, wherein supposing that said ball-hitting face is regarded as a clock surface and that a top position of said ball-hitting face is 12 o'clock, said modified fiber reinforced resinous layer is disposed at one position or two or more positions selected from among a first position in a range of 11 o'clock to one o'clock, a second position in a range of three o'clock to five o'clock (nine o'clock to seven o'clock), and a third position disposed at said left and right throat parts.

8. The racket frame according to claim 1, wherein a thermosetting resin is used as a resinous component of said modified resinous composition; said thermosetting resin is used as a resinous component of said of a matrix resin of said fiber reinforced resinous layer; and said loss factor (=tan δ) of said modified resinous composition is set to not less than 0.01 nor more than 0.5.

9. The racket frame according to claim 8, wherein said modified resinous composition contains epoxy resin and one or more activators selected from a compound having benzotriazole groups and a compound having diphenyl acrylate groups; and a tensile modulus of elasticity of a reinforcing fiber of said modified fiber reinforced resinous layer is set to not less than 150 GPa nor more than 600 GPa.

10. The racket frame according to claim 8, comprising a head part forming an outline of a ball-hitting face thereof and a bifurcated throat part connected to said head part, wherein supposing that said ball-hitting face is regarded as a clock surface and that a top position of said ball-hitting face is 12 o'clock, said modified fiber reinforced resinous layer is disposed at one position or two or more positions selected from among a first position in a range of 11 o'clock to one o'clock, a second position in a range of three o'clock to five o'clock (nine o'clock to seven o'clock), and a third position disposed at said left and right throat parts.

11. The racket frame according to claim 1, wherein said modified resinous composition contains epoxy resin and one or more activators selected from a compound having benzotriazole groups and a compound having diphenyl acrylate groups; and a tensile modulus of elasticity of a reinforcing fiber of said modified fiber reinforced resinous layer is set to not less than 150 GPa nor more than 600 GPa.

12. The racket frame according to claim 11, comprising a head part forming an outline of a ball-hitting face thereof and a bifurcated throat part connected to said head part, wherein supposing that said ball-hitting face is regarded as a clock surface and that a top position of said ball-hitting face is 12 o'clock, said modified fiber reinforced resinous layer is disposed at one position or two or more positions selected from among a first position in a range of 11 o'clock to one o'clock, a second position in a range of three o'clock to five o'clock (nine o'clock to seven o'clock), and a third position disposed at said left and right throat parts.

13. The racket frame according to claim 1, comprising a head part forming an outline of a ball-hitting face thereof and a bifurcated throat part connected to said head part, wherein supposing that said ball-hitting face is regarded as a clock surface and that a top position of said ball-hitting face is 12 o'clock, said modified fiber reinforced resinous layer is disposed at one position or two or more positions selected from among a first position in a range of 11 o'clock to one o'clock, a second position in a range of three o'clock to five o'clock (nine o'clock to seven o'clock), and a third position disposed at said left and right throat parts.

* * * * *